US005201814A

United States Patent [19]

Kitchell et al.

[11] Patent Number: 5,201,814

[45] Date of Patent: Apr. 13, 1993

[54] BREAKAWAY COUPLING DEVICE

[75] Inventors: Ricky W. Kitchell; Larry L. Newlin, both of Ponca City, Okla.

[73] Assignee: Conoco Inc., Ponca City, Okla.

[21] Appl. No.: 824,668

[22] Filed: Jan. 23, 1992

[51] Int. Cl.[5] ..... E21B 23/00

[52] U.S. Cl. ..... 166/65.1; 166/377; 166/385; 285/2; 285/4

[58] Field of Search ..... 166/65.1, 242, 377, 166/117, 385; 285/1, 2, 3, 4

[56] References Cited

U.S. PATENT DOCUMENTS

| | | | |
|---|---|---|---|
| 3,794,057 | 2/1974 | Badger | 285/4 X |
| 4,064,953 | 12/1977 | Collins | 285/3 X |
| 4,624,308 | 11/1986 | White | 166/65.1 |
| 4,648,444 | 3/1987 | Busch | 166/65.1 |
| 4,706,744 | 11/1987 | Smith et al. | 166/65.1 |
| 4,736,797 | 4/1988 | Restarick, Jr. et al. | 166/301 |
| 4,753,291 | 6/1988 | Smith et al. | 166/65.1 |
| 4,759,406 | 7/1988 | Smith et al. | 166/65.1 |
| 4,921,438 | 5/1990 | Godfrey et al. | 439/190 |
| 5,109,921 | 5/1992 | Aracenov | 166/65.1 |

*Primary Examiner*—Hoang C. Dang

*Attorney, Agent, or Firm*—M. Kathryn Braquet Tsirigotis

[57] ABSTRACT

The present invention provides a non-complex, simple to use and economical coupling device or connecting two elements, which provides for disconnection of the two elements when the tension applied to the coupling device exceeds a predetermined load. The coupling device includes an outer and an inner sleeve each having an axial bore. The lower end of the inner sleeve is slidably disposed within the upper end of the outer sleeve and the sleeves are relatively moveable. A frangible elongated member with a predetermined tensile strength connects the outer and inner sleeves through the axial bores. The frangible member breaks under a predetermined amount of stress thereby allowing the outer and inner sleeves of the coupling device to separate and disconnecting the attached elements. One or more internal longitudinal passages through the outer and inner sleeves adjacent to the axial bores allow passage of wire cables, gases, fluids or mechanical linkages through the coupler. A plurality of o-ring seals may be positioned between the lower end of the inner sleeve and the upper end of the outer sleeve whereby the internal passages of the coupler are pressure sealed from moisture and external contaminates.

12 Claims, 3 Drawing Sheets

BREAKAWAY COUPLING DEVICE

BACKGROUND OF THE INVENTION

1. Field of the Invention

The present invention relates generally to a coupling device which protects against tension overloads when used to connect two elements which are placed under tension, in particular those coupling devices which are used in a wellbore with downhole tools.

2. Discussion of the Related Art

In general, it has been found useful in an oil well or wellbore to use couplers placed between an electrical signal conducting cable and downhole tools to protect against tension overloads on the cable. In operations for producing hydrocarbon fluids difficulties arise when the downhole tools become stuck in the borehole which can cause a tension overload when the cable is used to remove the tool from the wellbore. Coupling devices or connectors which break the connection between the cable and downhole tools prevent damage to the cable and the tool due to the tension overloads. Various coupling devices are known in the prior art for this purpose. However, as is well known in the art, such couplers have had many disadvantages and many problems associated therewith and which are described hereinafter.

A coupler or connection between a cable or conduit and a downhole tool serves three principle functions: first to securely fasten the cable or conduit to the downhole tool; second, to provide a means for preferential breaking of the connection between the cable and the tool to avoid damage to the cable and tool and protect against tension overloads; third, to allow electric wires, fluids, gases or mechanical linkages to pass through the coupler without contamination by external materials. The function of providing a means of preferential breaking of the connection at a predetermined tensile load level is important because it is fairly common for cable-supported tools to become stuck in boreholes. This function permits the operator to preserve the majority of the cable in the event the tool string becomes hopelessly stuck in the borehole. It should be noted however that the coupling or connection must be strong enough to support the static weight of the tool string suspended from the cable. The coupling or connection must also be strong enough to support the weight of any additional loads imparted to the tool during normal operation or in reasonable efforts to free the tool string should it become stuck.

Known coupling devices or connectors employing breakaway elements suffer numerous disadvantages. For example, prior art devices are unreliable in their failure points. Many prior art devices are difficult to inspect to insure that the weak point element has not been partially stressed even though it remains unbroken and will thus have an unpredictable failure point. Many prior art devices are also complex in their structure and do not have the advantage of being easily adjustable or reusable after breakage.

Some prior art devices have made use of a shear pin in a position perpendicular to the longitudinal axis of the coupler as the weak point element of the coupler or connection. However, there are numerous problems associated with the use of a shear pin in a breakaway coupling device. Shear pins do not break clean under stress and therefore have jagged edges which tear up the coupling device after breakage. When a shear pin breaks jagged and tears up the coupler or connector, the coupler or connector cannot be used again. Also, the repeated use of a device using shear pins may cause the device to become unreliable in its failure point due to changes caused in the device by the shear pins themselves. Another problem occurs when the shear pin only partially shears and the coupler or connector cannot then be pulled apart. Therefore, prior art devices using a shear pin are not easily reusable.

In addition to the drawbacks previously noted, prior art coupling devices have also had numerous problems with contamination of the internal passages by external materials such as fluid and solids from the borehole. Since such things as electrical wires and cables must run through the coupler, it is essential that no moisture or contamination leaks into the interior of the coupler. Many prior art devices use a face seal which may leak when subjected to large loads which stretch the coupler but do not break the connection.

Accordingly, prior to the development of the present invention, there has been no downhole breakaway coupling device adapted for use in a wellbore which: is noncomplex in structure and is simple and economical to use; provides a high degree of predictability of tensile and load strength and breakpoint; provides for easy adjustability of the breakpoint; provides a coupler which is easily reusable after the failure point of the coupler is reached; allows electric wires, fluids, gases or mechanical linkages to pass through the coupler without contamination by external materials; and provides a retrieval notch whose function is to aid in retrieving downhole tools stuck in a borehole after breakage of the coupler.

SUMMARY OF THE INVENTION

The present invention provides a non-complex and simple to use coupling device for connecting two elements, which provides for disconnection of the two elements when the tension applied to the coupling device exceeds a predetermined load. The coupling device includes an outer and an inner sleeve each having an axial bore. The lower end of the inner sleeve is slidably disposed within the upper end of the outer sleeve and the sleeves are relatively moveable. A frangible bolt with a predetermined tensile strength connects the outer and inner sleeves through the axial bores. The bolt breaks under a predetermined amount of stress thereby allowing the outer and inner sleeves of the coupling device to separate and disconnecting the attached elements.

One or more internal longitudinal passages through the outer and inner sleeves adjacent to the axial bores allow passage of wire cables or gas or fluid conduits through the coupler. A plurality of o-ring seals may be positioned between the lower end of the inner sleeve and the upper end of the outer sleeve whereby the internal passages of the coupler are pressure sealed from moisture and external contaminates.

In accordance with one aspect of the present invention, there is provided a simple coupling device for interconnecting a subsurface or downhole tool with a sheathed or armored cable and wherein electrical conductors extend through the cable and the coupling device to the downhole tool. The frangible coupling device of the present invention provides for disconnection of the cable from the downhole tool in the event the tool becomes stuck in the wellbore. A portion of the coupling device remains connected to the downhole tool to facilitate retrieval of the tool and the still attached portion of the coupling device. The present invention also provides for passage of fluids or gases to the downhole tool from a connected cable or tubing string.

A feature of the present invention resides in the fact that it is a non-complex structure which provides for easy reusability and easy adjustability. The frangible bolt is the only part of the coupling device that is fractured when the coupler disconnects. Therefore, the broken bolt can be removed and the coupling device then reassembled with a new frangible bolt. This same feature provides for easy adjustment of the tensile strength of the coupling device also. Through the use of bolts of different materials and different tensile strengths or a bolt which includes a portion with a smaller cross section, the strength of the coupling device may be easily adjusted.

Another feature of the present invention resides in the fact that the inner sleeve is slidably disposed within the outer sleeve in a design similar to a piston and cylinder arrangement. This design seals the internal passages from external contaminates even when the coupler is subjected to a large load which stretches but does not disconnect the coupler. A plurality of o-rings are positioned between the inner and outer sleeves which provides a pressure seal against external contaminates. The seal between the inner and outer sleeves remains even though the sleeves move relative to each other.

The coupling device of the present invention, adapted for use in a wellbore, when compared with previously proposed prior art coupling devices has the advantages of: being non-complex in structure and simple and economical to use; being reusable after disconnection of the coupler; being easily adjustable; and providing internal passages which are free from external contaminates even under heavy loads.

DESCRIPTION OF THE PREFERRED EMBODIMENT

Figure 1:
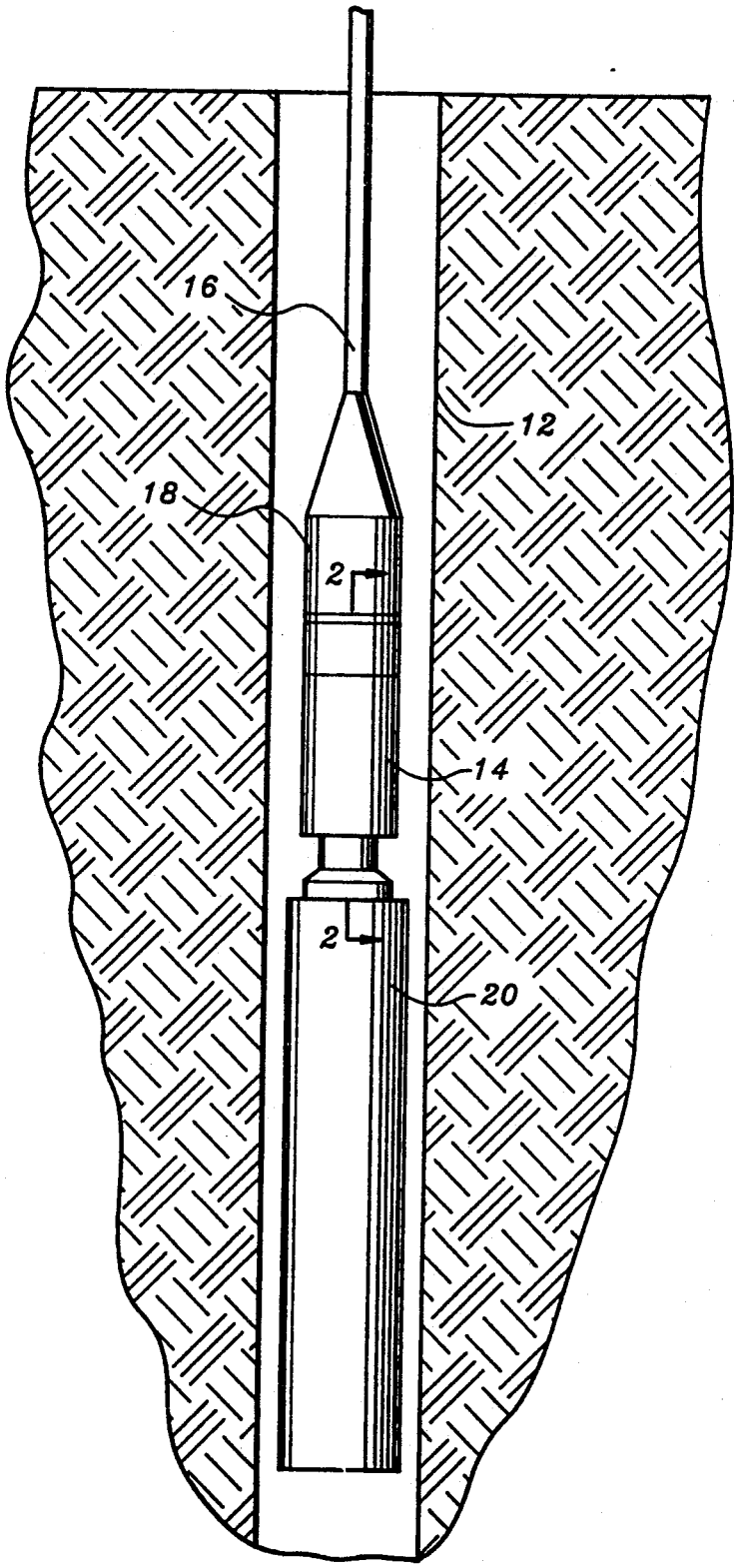
FIG. 1 is a plan view of an implementation system of the coupling device in a wellbore.

In the description which follows, like parts are marked throughout the specification and drawings with the same reference numerals respectively. The drawing figures are not necessarily to scale and certain features of the invention may be shown exaggerated in scale in the interest of clarity and conciseness.

An envisioned implementation of the present invention is illustrated in FIG. 1. In a wellbore or borehole 12, a frangible or breakaway coupling device 14 connects an armored electrical signal conducting cable 16, which is attached to breakaway coupling device 14 through the use of a cable connector 18, and any downhole tool 20 which is to be connected to the cable 16. The breakaway coupling device 14 protects the cable 16 from being stretched beyond a specific load limit in the event the tool 20 becomes stuck in the borehole 12.

The coupling device can similarly be adapted to protect any conduit, such as a tube or hose supplying fluids or gases used by a downhole tool, against inadvertent overloads. The coupling device provides this protection by providing a frangible elongated member which breaks when an overload is imminent thereby allowing separation between the cable and the tool to occur in the coupling device itself.

Figure 2:
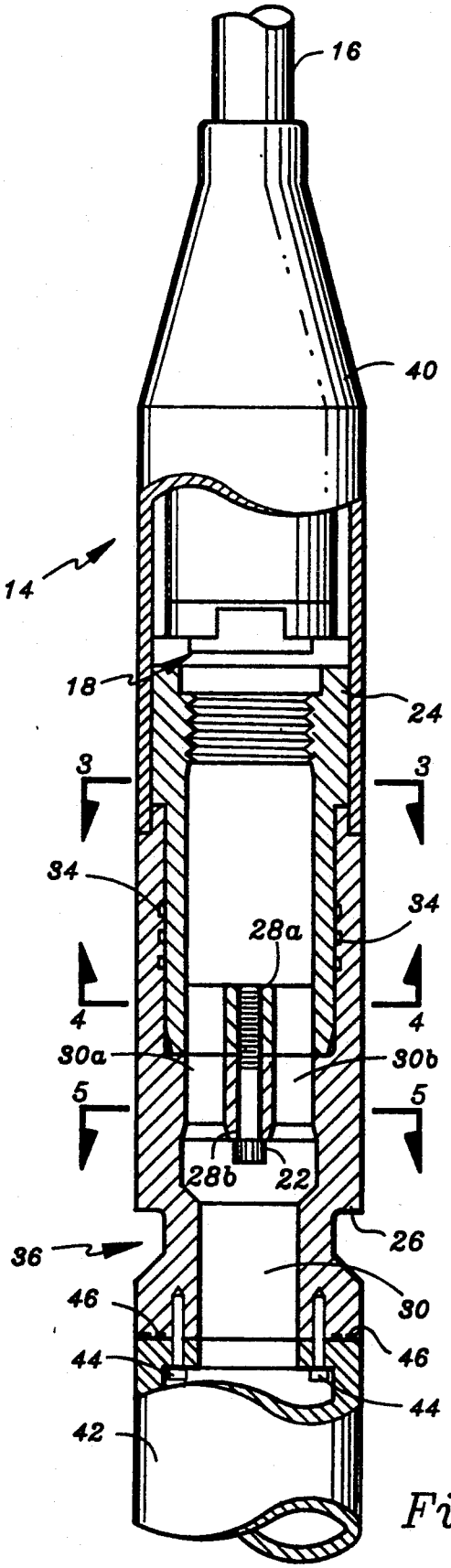
FIG. 2 is a cross-sectional view of the coupling device along lines 2—2 in FIG. 1.

As shown in FIG. 2, there is illustrated in longitudinal cross section the breakaway coupling device 14 of the present invention as it would be used in a wellbore. The coupling device 14 includes an inner sleeve 24 for connecting to an element, which as illustrated is an armored or sheathed cable 16. The cable 16 is shown connected to the inner sleeve 24 through the use of a cable connector 18. The cable 16 is attached to the cable connector 18 in any conventional manner which provides a sealed attachment. An outer sleeve 26 is connected to another element, such as a downhole tool which may be connected to the outer sleeve 26 through the use of a tool adapter 42 as illustrated. The tool may be attached to the tool adapter 42 in a conventional manner. Both the inner sleeve 24 and the outer sleeve 26 have axial bores 28*a* and 28*b* therein, generally aligned with each other. The inner sleeve 24 is slidably disposed within the outer sleeve 26 which allows the outer sleeve 26 and the inner sleeve 24 to be relatively moveable with each other.

A frangible means having a predetermined tensile strength, illustrated in FIG. 2 as a frangible or breakaway bolt 22, connects the outer and inner sleeves 26 and 24 through the generally aligned axial bores 28*a* and 28*b*. When a predetermined tensile strength is exceeded the frangible bolt 22 fractures or breaks disconnecting the outer and inner sleeves 26 and 24. Therefore the cable 16 is disconnected from the downhole tool and tool adapter 42 in the event the tool becomes stuck in the wellbore.

A feature of the present invention resides in the fact that it is a non-complex structure which provides for easy reusability and easy adjustability. The frangible bolt 22 is the only part of the coupling device 14 that is fractured when the coupler 14 disconnects. Therefore, the broken bolt can be removed and the coupling device 14 then reassembled with a new frangible bolt. This same feature provides for easy adjustment of the breakpoint of the coupling device 14 also. Through the use of bolts or any frangible elongated members of different materials and different tensile strengths, the tensile strength of the coupling device may be easily adjusted. This same feature also provides for reliability in the failure point of the frangible bolt. The coupling device is easy to inspect between uses in a wellbore to insure that the frangible bolt or weak point element has not been partially stressed even though it remains unbroken. Inspection will thus insure a predictable tensile strength failure point for the coupling device.

Both the inner sleeve 24 and the outer sleeve 26 have one or more internal longitudinal passages 30*a* and 30*b* which allows a cable or conduit to pass through the coupling device and gain access to the tool through the coupling device. The passages 30*a* and 30*b* are located longitudinally adjacent to the axial bores 28*a* and 28*b*.

Figure 3:
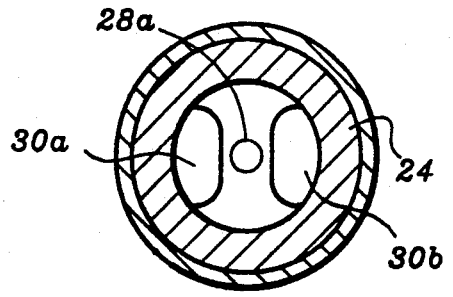
FIG. 3 is a cross-sectional view along lines 3—3 of the upper portion of the coupling device in FIG. 2.
Figure 4:
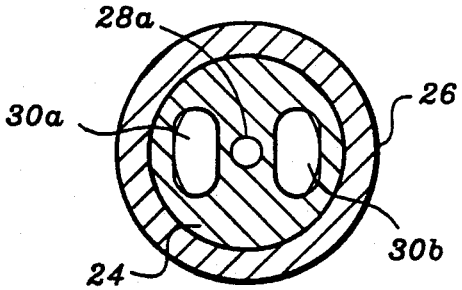
FIG. 4 is a cross-sectional view along lines 4—4 of the center portion of the coupling device in FIG. 2.
Figure 5:
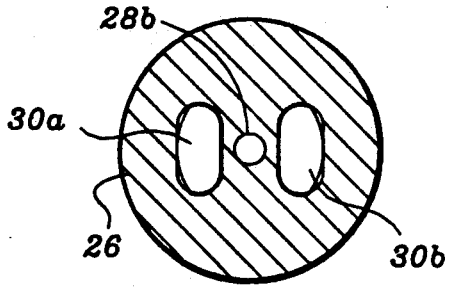
FIG. 5 is a cross-sectional view along lines 5—5 of the lower portion of the coupling device in FIG. 2.

FIGS. 3, 4 and 5 show the passages 30*a* and 30*b* through inner sleeve 24 and through outer sleeve 26 and longitudinally adjacent to the axial bores 28*a* and 28*b*, the passages 30*a* and 30*b* being generally aligned from one sleeve to the other.

In FIG. 2, the two passages 30*a* and 30*b* converge into one passage 30 at the lower end of the outer sleeve 26. The cable 16 illustrated in FIG. 2 may be a conventional multiple conductor cable having a plurality of electrical conductors disposed within a sheath. The cable 16 is attached in a conventional manner to the cable connector 18 which is connected to the coupling device 14 and the electrical conductors may pass through the passages 30*a* and 30*b* of the coupling device 14 to the downhole tool. Separation of the coupling device 14 as described above would typically result in parting of the conductors at some point between the cable connector 18 and the downhole tool.

However, a similar design could contain two or more completely separate passages through the coupling device which would allow multiple fluids, gases or signal conductors to pass through the coupling device without contamination. The passage 30 could also allow mechanical linkages to pass through the coupling device, connecting operations in an upper assembly to a lower assembly.

A plurality of o-rings 34 may be positioned between the inner sleeve 24 and the outer sleeve 26 whereby the internal passages 30*a* and 30*b* are pressure sealed against external contaminates. These o-ring seals 34 prevent any leakage even if the inner sleeve 24 and the outer sleeve 26 move relative to one another under heavy loads which may stretch but not break the coupler 14. The seal between the inner and outer sleeves 24,26 remains even when the sleeves move relative to each other. This is an important feature of the coupling device when using electrical wires or mechanical linkages through the coupling device 14 so as not to allow moisture or external contaminants into the internal passages 30*a* and 30*b* of the coupling device 14. Prior art devices have used face seals which may leak when subjected to large loads which is prevented by the piston and cylinder arrangement of the inner sleeve 24 and the outer sleeve 26. Other conventional seals may be positioned between the inner and outer sleeves 24, 26 for pressure sealing the internal passages.

Also illustrated in FIG. 2 is a retrieval notch 36 on the lower end of the outer sleeve 26 of the coupling device 14. In the event the tool becomes stuck in the wellbore 12, a portion of the coupling device 14, the outer sleeve 26, remains attached to the downhole tool and the tool adapter 42. The function of the retrieval notch 36 is to aid in retrieving the outer sleeve 26 portion of the coupling device 14 and the tool which is attached to the outer sleeve 26 from the wellbore in the event the bolt 22 is broken. The terms upper and lower mentioned herein are for convenience only and refer to the relative locations of the respective members so designated when the coupling device 14 is inserted in a generally vertically extending wellbore.

In the embodiment of the present invention illustrated in FIG. 2, breakaway coupling device 14 is connected to cable 16 which is attached to the upper end of the inner sleeve 24 through the use of a cable connector 18. The upper end of the inner sleeve 24 is threaded to allow attachment of the cable connector 18. A shroud 40 covers the cable 16, the cable connector 18 and the upper end of the inner sleeve 24. The shroud 40 provides a smooth outer surface between the cable 16 and the coupling device 14 to facilitate use in a wellbore.

On the lower end of the outer sleeve 26, a tool is attached to the coupling device 14 through the use of a tool adapter 42. The tool adapter 42 may be attached to the coupling device 14 with a plurality of threaded bolt connectors 44. The lower end of the outer sleeve 26 is shown with stud bolt connectors 44 and o-ring seals 46 positioned between the outer sleeve 26 and tool adapter 42 to provide a means of attaching tool adapter 42 and tools in a sealed manner.

Although the embodiment shown in FIGS. 1 and 2 show the use of the coupling device 14 between an signal conducting cable 16 and a downhole tool 20, the breakaway coupling device 14 may of course be used between any two assemblies to be interconnected and protected against inadvertent tension overload. When the coupling device 14 is to be used with different assemblies, the methods of attachment to the upper and lower assemblies may be altered, however, the function of the breakaway coupling device 14 will remain the same.

Figure 6:
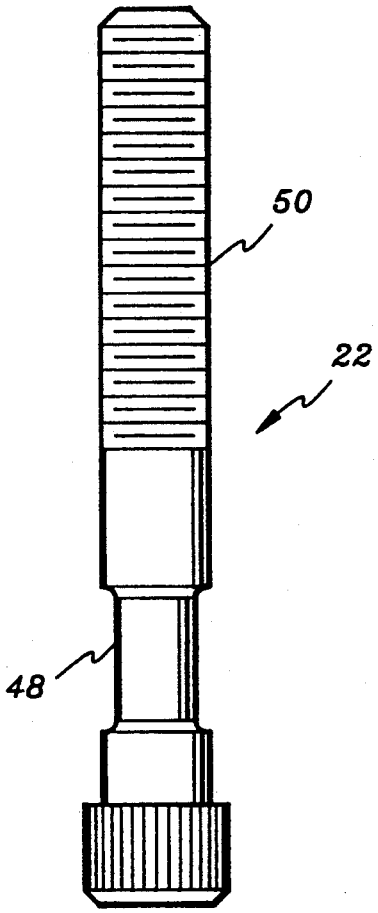
FIG. 6 is an alternate embodiment of the frangible bolt used in the coupling device of the present invention.

The embodiment of the present invention shown in FIG. 2 is reusable since the breakaway bolt 22 is the only part of the coupling device 14 that is broken when the coupling device 14 is pulled apart. Once the bolt 22 has been broken, it can easily be removed and the coupling device 14 can then be reassembled with a new bolt 22. It is not required that identical bolts are used each time the coupling device is used. Therefore, with the use of different bolts, the coupling device may be adjusted. The amount of protection against tension stress overload may be predicted by evaluation of the tensile strength of the bolt. As shown in FIG. 6, a bolt 22 may also have a reduced cross sectional portion 48 in addition a threaded section 50 of the bolt 22 which would provide for a different tensile strength. Therefore, with the use of bolts of different types of materials and machining portions of the bolts to different diameters, the coupling device can provide protection against a wide range of loads.

While there has been illustrated and described a particular embodiment of the present invention, it will be appreciated that numerous changes and modifications will occur to those skilled in the art, and it is intended in the appended claims to cover all those changes and modifications which fall within the true spirit and scope of the present invention.

What is claimed is:

1. An apparatus for working in a wellbore, comprising:

at least one downhole tool for operation in a wellbore;

a cable for lowering and raising said tool in the wellbore, said cable including signal conductors for transmitting signals between said tool and the earth's surface;

a coupling device connecting one end of said cable to said tool, said coupling device comprising an outer sleeve for connecting to one end of said cable and having an axial bore therein, an inner sleeve for connecting to said tool and having an axial bore therein generally aligned with said axial bore of said outer sleeve, said inner sleeve slidably disposed within said outer sleeve wherein said outer sleeve and said inner sleeve are relatively moveable, a frangible means having a predetermined tensile strength connecting said outer and inner sleeves through said axial bores, and a passage means extending through said outer and inner sleeves from said cable to said tool, said passage means located longitudinally adjacent to said axial bores, wherein said coupling device allows disconnection between the cable and the tool when tension applied to the coupling device exceeds the predetermined tensile strength of the frangible means.

2. The apparatus of claim 1, wherein said coupling device further includes a plurality of o-ring seals positioned between said inner sleeve and said outer sleeve wherein said passage means is pressure sealed from external contaminates.

3. The apparatus of claim 1, wherein said frangible means of said coupling device is an elongated member adapted to fracture under a predetermined amount of stress, wherein said inner and outer sleeves are then disconnected, said elongated member being removable and replaceable after fracturing and disconnection of the inner and outer sleeves.

4. The apparatus of claim 3, wherein said elongated member is a bolt connecting said outer and inner sleeves through said axial bores; and at least one nut secures said bolt in said axial bores.

5. The apparatus of claim 3 wherein said axial bores are threaded; and said elongated member is a threaded bolt connecting said outer and inner sleeves through said axial threaded bores.

6. The apparatus of claim 3, wherein said elongated member has a reduced cross sectional portion.

7. The apparatus of claim 1, wherein said passage means includes at least one internal longitudinal passage adapted to allow passage through said coupling device from one element to the other element without contamination from materials external to said inner and outer sleeves.

8. The apparatus of claim 7, wherein said internal passage is adapted to allow access by said signal conductors through said coupling device for transmitting signals between said tool and the earth's surface.

9. The apparatus of claim 7, wherein said internal passage is adapted to allow for the passage of gases, fluids and mechanical linkages through said coupling device from said cable to said tool.

10. The apparatus of claim 1, further including a cable connector and a molded cable head for connecting said cable to said inner sleeve of said coupling device; and a shroud covering said inner sleeve and cable connection thereby providing a smooth surface to facilitate use of said coupling device in the wellbore.

11. The apparatus of claim 10, further including a tool adapter connected to said outer sleeve of said coupling device for connecting to said tool.

12. The apparatus of claim 1, further including a means formed on an outer wall surface of the outer sleeve of said coupling device for allowing retrieval of said outer sleeve and said tool from the wellbore after said coupling device has disconnected the cable and the tool.

* * * * *